US005819792A

United States Patent [19]

Reynolds

[11] Patent Number: 5,819,792

[45] Date of Patent: Oct. 13, 1998

[54] CHECK BALL VALVE SEAT

[75] Inventor: Steven M. Reynolds, Lucas, Ohio

[73] Assignee: Warren Rupp, Inc., Mansfield, Ohio

[21] Appl. No.: 811,630

[22] Filed: Mar. 5, 1997

[51] Int. Cl.[6] ..... F16K 15/04

[52] U.S. Cl. ..... 137/515.7; 137/533.11

[58] Field of Search ..... 137/515.7, 533.11, 137/539, 539.5

[56] References Cited

U.S. PATENT DOCUMENTS

| | | | |
|---|---|---|---|
| 1,284,641 | 11/1918 | Francis | 137/515.7 |
| 2,790,460 | 4/1957 | Radd | 137/515.7 |
| 3,346,008 | 10/1967 | Scaramucci | 137/515.7 |
| 3,359,995 | 12/1967 | Parisi | 137/539 |
| 3,776,258 | 12/1973 | Dockins | 137/533.11 |
| 4,148,338 | 4/1979 | Skoli | 137/515.7 |
| 4,197,875 | 4/1980 | Schieferstein | 137/539 |
| 4,274,436 | 6/1981 | Smith | 137/515.7 |
| 4,286,622 | 9/1981 | Ninomiya | 137/539 |
| 4,474,208 | 10/1984 | Looney | 137/539.5 |
| 4,687,018 | 8/1987 | Eagen | 137/515.7 |
| 4,781,213 | 11/1988 | Kilayko | 137/533.15 |
| 4,971,103 | 11/1990 | Scaramucci | 137/515.7 |
| 5,195,552 | 3/1993 | Nehm | 137/533.11 |
| 5,232,014 | 8/1993 | Hitebrand | 137/515.7 |
| 5,240,037 | 8/1993 | Guinn | 137/515.7 |
| 5,297,580 | 3/1994 | Thurman | 137/533.15 |

FOREIGN PATENT DOCUMENTS

| | | | |
|---|---|---|---|
| 1004004 | 3/1957 | Germany | 137/515.7 |
| 814287 | 6/1959 | United Kingdom | 137/515.7 |

*Primary Examiner*—John Rivell
*Assistant Examiner*—Ramyar Farid
*Attorney, Agent, or Firm*—Hill & Simpson

[57] ABSTRACT

A check ball valve seat assembly for a diaphragm pump is provided that includes an annular carrier plate which accommodates an annular seat member. The assembly is sandwiched between two components of a diaphragm pump, such as a component for providing a retainer for the ball component of the check valve and a retainer providing a backing support for the check ball valve seat assembly. The annular seat member sealingly engages the ball retainer component and the support component of the pump which prevents the fluid that is being pumped from coming into contact with the annular carrier plate.

7 Claims, 2 Drawing Sheets

CHECK BALL VALVE SEAT

FIELD OF THE INVENTION

The present invention is directed toward pumps and, more specifically, to fluid powered diaphragm pumps. Still more specifically, the present invention is directed toward improved check ball valve seats for use in fluid powered diaphragm pumps.

BACKGROUND OF THE INVENTION

Fluid powered diaphragm pumps which incorporate ball-type check valves are known. One particularly successful design is illustrated in FIG. 1 which is a schematic illustration of a diaphragm pump sold under the SANDPIPER® trademark by Warren Rupp, Inc. of Mansfield, Ohio. The pump 10 as illustrated in FIG. 1 includes two diaphragm chambers shown at 11 and 12. Flexible diaphragms 13, 14 are mounted in each chamber 11, 12 respectively. The diaphragms 13, 14 divide the pumping sections, or the pumping chambers 11, 12, from the air driving section or air driving chambers shown at 15, 16. The two diaphragms 13, 14 are connected by a diaphragm rod 17.

As air enters the chamber 16, it drives the diaphragm 14 outward on a discharge/pump stroke. This action forces the fluid out of the chamber 12, through the check valve 18, through the manifold 19 and out the discharge outlet 21 as shown by the arrows 22, 23. As the diaphragm 14 is pushing the fluid out through the outlet 21, the diaphragm rod 17 is pulling the diaphragm 13 inward on a suction stroke causing the chamber 11 to fill with fluid which enters through the inlet port 24, into the manifold 25 and through the check valve 26 as indicated by the arrows 27, 28. At the end of each stroke, the air distribution valve 29 automatically shifts, reversing the entire sequence. The check valve 31 prevents fluid that is being pumped from the chamber 12 and out through the outlet 21 from entering the chamber 11 as illustrated in FIG. 1. Similarly, when fluid is being pumped from the chamber 11, through the manifold 19 and out the outlet 21, that fluid is prevented from entering the chamber 12 by the check valve 18. The check valves 26 and 32 both prevent fluid that is being pumped from the chambers 11, 12 respectively from entering the inlet manifold shown at 25.

The valve seats for the check valves 18, 26, 32, 31 are indicated generally at 33 in FIG. 1. Typically, these valve seats are unitary in design and are made from a single continuous material. Because diaphragm pumps like the one shown at 10 in FIG. 1 are used to pump various liquids, many of which may be corrosive, the materials from which the valve seats 33 are manufactured from must be varied, depending upon the liquid being pumped. Accordingly, different valve seats must be supplied for different pump applications.

Further, a large portion of the valve seat 33 never comes in contact with the material being pumped. When the valve seats 33 are constructed from expensive chemical-resistant materials, a large portion of the expensive material that does not come into contact with the liquid being pumped unnecessarily increases the cost of the valve seat.

Accordingly, there is a need for an improved check ball valve seat for use in diaphragm pumps in which the seat portion, or the portion of the material exposed to the fluid being pumped, can be fabricated from a different material than the remaining outer periphery of the valve seat.

SUMMARY OF THE INVENTION

The present invention provides a solution to the problems addressed above by providing a ball valve seat that is fabricated from two parts including an annular carrier plate and an annular seat element. The annular carrier plate includes an outer periphery that is attached between two components of the pump. Typically, the annular carrier plate is attached between an end of the manifold and the portion of the pump that houses a pumping chamber. The carrier plate includes a top side and a bottom side and an inner wall disposed at an inner periphery of the carrier plate which engages the annular seat element. The inner wall of the carrier plate further includes a cut-out portion disposed adjacent to the top side of the carrier plate. The cut-out portion has a wider diameter than the portion of the inner wall disposed adjacent to the bottom side of the carrier plate.

The annular seat element includes an outer wall for engaging the inner wall of the carrier plate. The outer wall of the seat element includes an upper flange that is accommodated in the upper cut-out portion of the carrier plate. The annular seat element is held in place by the component of the pump that engages the top side of the carrier plate. Additional stability is provided by the component of the pump that engages the bottom side of the carrier plate.

In an embodiment, the carrier plate is fabricated from an injection molded material.

In an embodiment, the annular seat element is fabricated from an elastomer material.

In an embodiment, the annular seat element further comprises an upper peripheral rib which engages the component of the pump assembly that also engages the top side of the carrier plate. The upper peripheral rib provides an improved seal between the seat element and the component of the pump assembly.

In an embodiment, the annular seat element includes a lower peripheral rib which engages the component of the pump assembly but also engages the bottom side of the carrier plate. The lower peripheral rib improves the seal between the annular seat element and the component of the pump assembly.

In an embodiment, the engagement between the upper and lower peripheral ribs of the annular seat element prevent fluid from being communicated through the check valve from coming into contact with the annular carrier plate.

In an embodiment, the components of the pump may include a peripheral groove for accommodating upper and lower peripheral ribs of the seal element to enhance the sealing engagement between the seal and the two components between which the seal is sandwiched.

In an embodiment, the first side of the seat element further comprises a first peripheral rib for directly engaging the ball retainer component and providing a seal between the seat element and the ball retainer component. The first side of the seat element further comprises a first peripheral channel disposed radially inwardly from the first peripheral rib. The first peripheral channel accommodates at least a portion of the first peripheral rib as the first side of the seat element is pressed against the ball retainer component.

In an embodiment, the second side of the seat element also comprises a second peripheral rib for directly engaging the support component and for providing a seal between the seat element and the support component. The second side of the seat element further comprises a second peripheral channel disposed radially inwardly from the second peripheral rib. The second peripheral channel accommodates at least a portion of the comprises a second peripheral channel disposed radially inwardly from the second peripheral rib. The second peripheral channel accommodates at least a portion of the second peripheral rib as the second side of the seat element is pressed against the support component.

The present invention also provides an improved air operated diaphragm pump that comprises an outer chamber which is connected to a manifold assembly. The pump also includes a ball valve disposed between the outer chamber and the manifold. The ball valve comprises a ball valve seat mounted between a first component that comprises either a ball retainer or a support for a ball valve seat and a second component that comprises the other of a ball retainer or support for a ball valve seat. The improvement contributed by the present invention lies in the ball valve seat assembly which comprises an annular carrier plate and an annular seal element as described above.

The present invention also provides a method of fabricating a ball valve seat for a pump. The method of the present invention includes the step of injection molding an annular carrier plate from a first material followed by injection molding an annular seat element from a second material. The annular carrier plate includes an outer periphery and an inner wall disposed at the inner periphery of the carrier plate. The carrier plate further comprises a top side and a bottom side. The portion of the inner wall disposed adjacent to the top side of the carrier plate includes a cut-out portion having a wider diameter than a bottom portion of the inner wall disposed adjacent to the bottom side of the carrier plate. The annular seat element includes an outer wall for engaging the inner wall of the carrier plate. The outer wall of the seat element includes an upper step or flange which is accommodated in the upper cut-out portion of the carrier plate.

It is therefore an object of the present invention to provide an improved check ball valve seat assembly for a diaphragm pump.

Another object of the present invention is to provide an improved air operated diaphragm pump.

Still another object of the present invention is to provide an improved method of manufacturing pump check ball valve seats.

Another object of the present invention is to provide an improved two-piece check ball valve seat including a carrier plate in a seat element and wherein only the seat element engages the fluid that is being pumped.

Yet another object of the present invention is to provide an improved check ball valve seat including an annular carrier plate and an annular seat element and wherein the annular carrier plate can be fabricated from a single, inexpensive material regardless of the fluid being pumped.

Another object of the present invention is to provide an improved check ball valve seat which includes an annular carrier plate and an interchangeable annular seat element.

Other objects and advantages of the present invention will become apparent upon reading the following detailed description and appended claims, and upon reference to the accompanying drawings.

BRIEF DESCRIPTION OF THE DRAWINGS

For a more complete understanding of the present invention, reference should now be made to the embodiment illustrated in greater detail in the accompanying drawings and described below by way of an example of the invention.

In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
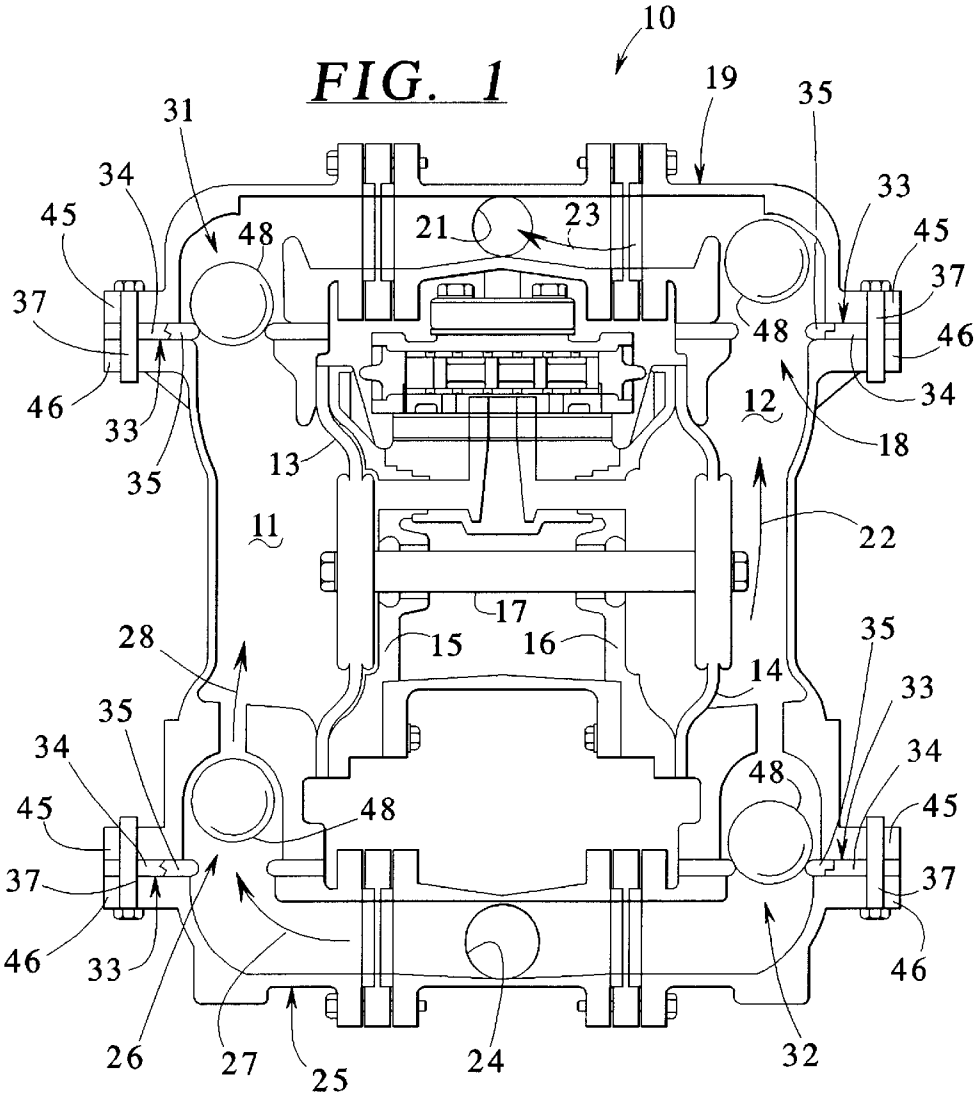
FIG. 1 is a schematic illustration of an air operated diaphragm pump including four check valves fabricated in accordance with the present invention.

As illustrated in FIG. 1, the pump 10 includes four check valves shown at 18, 32, 26 and 31. Each check valve includes a check ball valve seat assembly shown generally at 33. Each check ball valve seat assembly 33 is fabricated from two parts: an annular carrier plate shown generally at 34 and an annular seat element shown generally at 35. The annular carrier plate 34 and annular seat element 35 are described in more detail in FIGS. 2–4.

Figure 2:
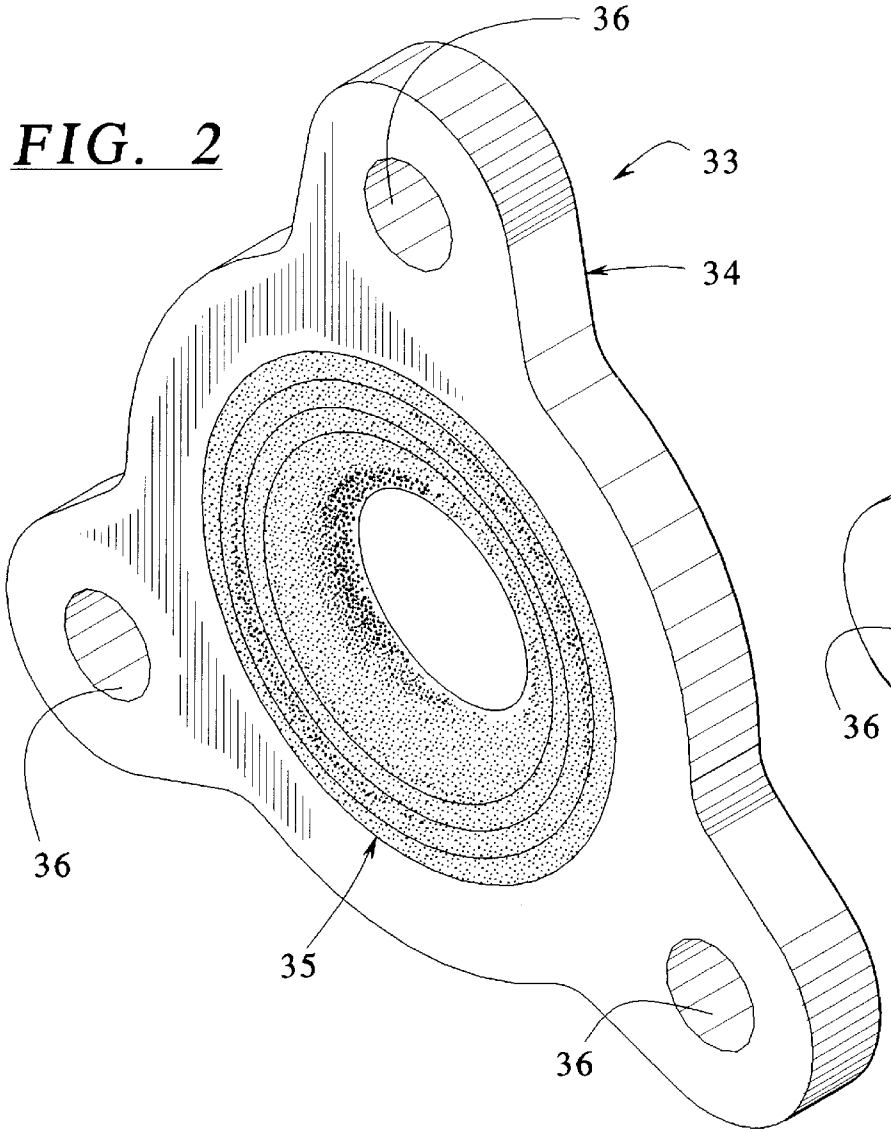
FIG. 2 is a perspective view of a check ball valve seat assembly made in accordance with the present invention.

FIG. 2 is a perspective view of a ball valve seat assembly 33 which includes a carrier plate 34 with an annular seat element 35 mounted therein. The annular carrier plate 34 includes a plurality of holes 36 for accommodating bolts used to sandwich the carrier plate 34 between two components of a pump as illustrated by the bolts shown generally at 37 in FIG. 1.

Figure 4:
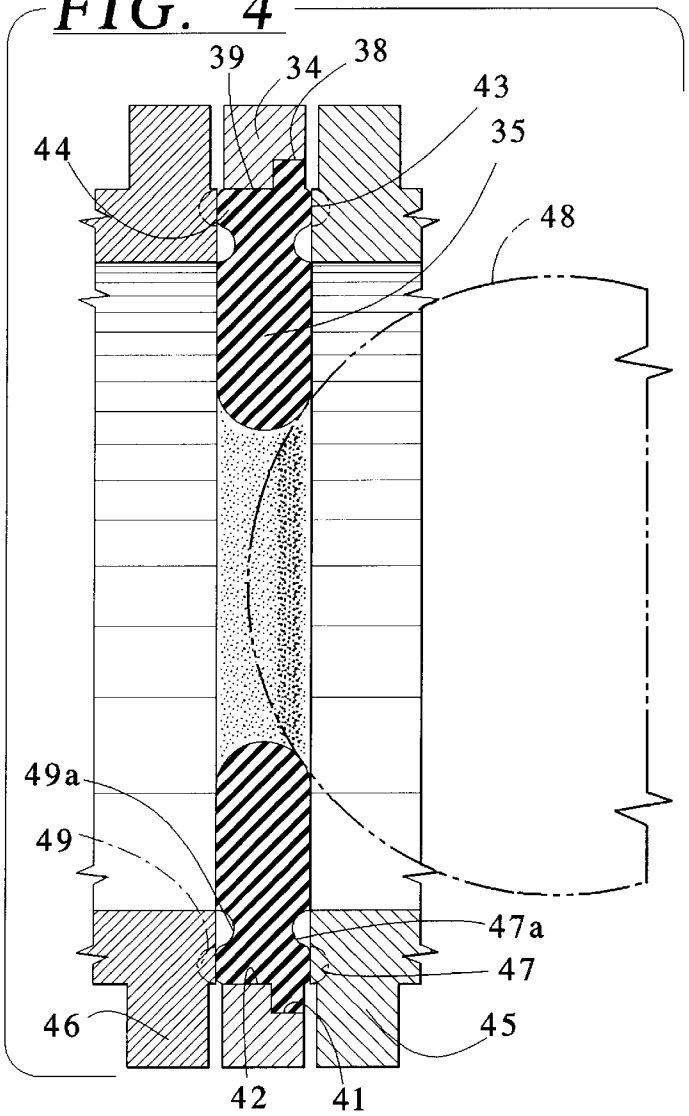
FIG. 4 is a sectional view of a check ball valve seat made in accordance with the present invention as installed in a diaphragm pump like the one illustrated in FIG. 1.
Figure 3:
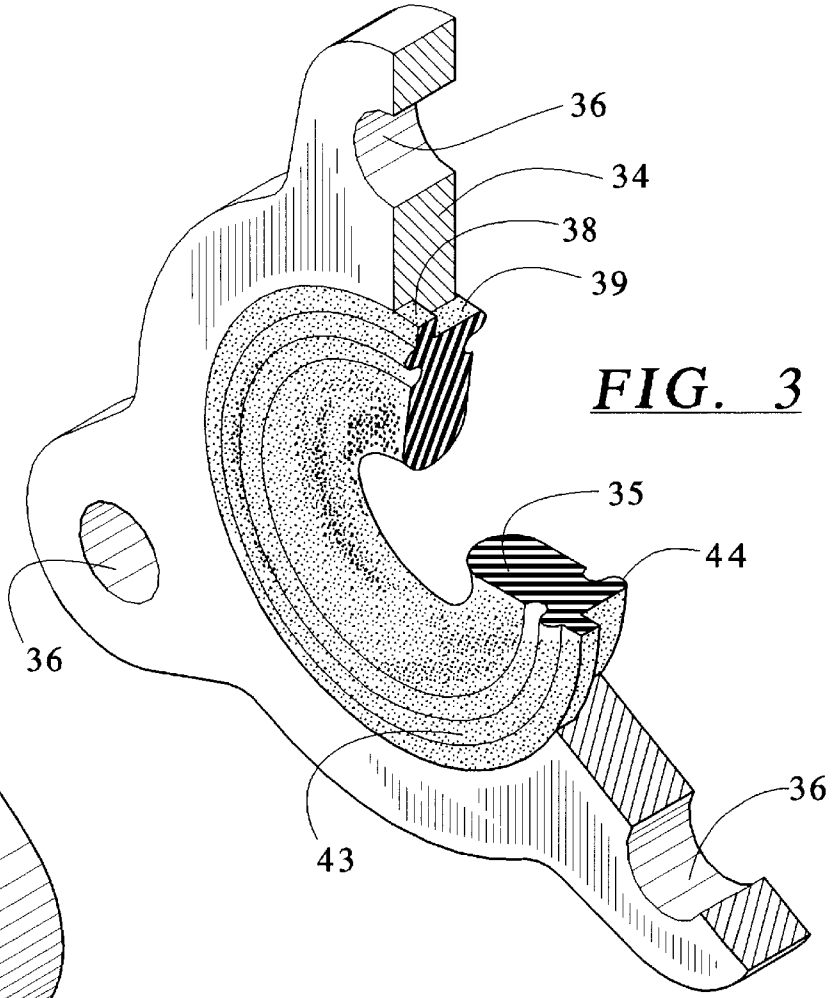
FIG. 3 is a partial perspective view of the check ball valve seat illustrated in FIG. 2.

FIG. 3 provides a sectional view of the check ball valve seat assembly 33 shown in FIG. 2 with a portion cut away to illustrate the upper flange or ledge 38 disposed on the interior wall 39 of the annular seat element which is accommodated in a cut-out portion 41 disposed along the inner wall 42 of the carrier plate 34 as illustrated in FIG. 4.

As also illustrated in FIGS. 3 and 4, the annular seat member 35 may optionally include an upper peripheral rib 43 and a lower peripheral rib 44. The ribs 43, 44 enhance the seal between the seat member 35 and the ball retainer component 45 and the ball valve seat support 46 as illustrated in FIGS. 1 and 4. Specifically referring to FIG. 4, the ball retainer component 45 may include a groove shown in phantom at 47 for accommodating the peripheral rib 43. Further, the ball valve seat support component 46 may include a groove 49 shown in phantom for accommodating the peripheral rib 44. The ball 48 engages the inner periphery of the seat member 35 as indicated in FIG. 1 and in phantom in FIG. 4. Peripheral grooves 47*a*, 49*a* are disposed radially inwardly from the ribs 43, 44 (see FIG. 3). The peripheral grooves 47*a*, 49*a* in the annular seat member 35 accommodate at least a portion of the ribs 43, 44 as the seat element 35 is pressed between the ball retainer component 45 and ball valve seat support component 46.

An advantage of the present invention includes the sealing engagement between the seat member 35 and the retainer component 45 and support component 46. By providing a seal between the seat member 35 and the components 45, 46, the fluid that is being pumped by the pump 10 does not come into contact with the annular carrier plate 34. Hence, the annular carrier plate 34 need not be fabricated from a material that is resistant to any chemical being pumped by the pump 10. As a result, the annular carrier plate 34 is standardized and need not be made from different materials, depending upon the material that is being pumped. Instead, the only element that must be varied is the annular seat element 35. The annular seat element 35, of course, must be fabricated from a material that can tolerate the liquid that is being pumped by the pump 10.

Therefore, the present invention provides an improved ball valve seat assembly 33 that comprises one standard part, the annular seat carrier 34 which accommodates an annular seat element 35, that must be fabricated from a material that can resist or tolerate the liquid that is being pumped by the pump 10. The annular carrier plate 34 may be fabricated from an injection molded material, such as a plastic material. The annular seat member 35 may also be fabricated from an injection molded material, such as an elastomer to provide a sufficient seal between the annular seat member 35 and the ball 48.

From the above description, it is apparent that the objects of the present invention have been achieved. While only certain embodiments have been set forth, alternative embodiments and various modifications will be apparent from the above description to those skilled in the art. For example, the peripheral ribs 43, 44 may be replaced by some other similar structure on the seat member 35. Further, the peripheral ribs 43, 44 need not be included in the structure of the annular seat member 35. Instead, the annular seat member may be provided in a somewhat thicker form to enhance the engagement between the pump components 45, 46. Further, the flange 38/cut-out portion 41 structures of the annular seat member 35 and annular carrier plate 34 may be replaced with other structures having a similar cooperating relationship. Instead, the outside wall 39 of the seat member 35 may include a rib and the inside wall 42 of the carrier plate 34 may include a cooperating notch. Further, the inside wall 42 of the carrier plate 34 may include an outwardly protruding rib and the outside wall 39 of the seat member 35 may include a cooperating groove or notch. These and other alternatives are considered equivalents and within the spirit and scope of the present invention.

What is claimed is:

1. A ball valve seat of a ball valve assembly for an air operated diaphragm pump, the ball valve seat being attached between first and second pump components, the ball valve seat sealingly engaging a ball of a ball valve assembly, the ball valve seat comprising:

a one-piece non-resilient flat annular carrier plate comprising an outer periphery for attachment between the first and second components by sandwiching the outer periphery of the carrier plate between the first and second components, the carrier plate further comprising an inner wall for accommodating a one-piece resilient annular seat element for engaging the ball of the ball valve assembly, the carrier plate further comprising a first side and a second side, the inner wall comprising a cut-out portion disposed at a junction of the inner wall and the first side of the carrier plate, the cut-out portion having wider diameter than a second portion of the inner wall deposed at a junction of inner wall and the second side of the carrier plate, the first side of the carrier plate engaging the first component, the second side of the carrier plate engaging the second component, the annular seat element comprising a central opening providing a flow path and an outer wall for engaging the inner wall of the carrier plate, the outer wall of the seat element comprising a flange that is accommodated in the cut-out portion of the carrier plate, the seat element further comprising a first side and a second side, the first side of the seat element having an outer periphery that sealingly engages the first component and provides a seal between the flow path and the first side of the carrier plate, the second side of the seat element having an outer periphery that sealingly engages the second component and provides a seal between the flow path and the second side of the carrier plate, the seat element being sandwiched between the first and second components at the outer peripheries of the first and second sides of the seat element and providing a seal between the flow path and the carrier plate, the first side of the annular seat element further comprising a first peripheral rib for directly engaging the first component and providing a seal between the seat element and the first component, the first side of the seat element further comprising a first peripheral channel disposed radially inwardly from the first peripheral rib, the first peripheral channel for accommodating at least a portion of the first peripheral rib as the first side of the seat element is pressed against the first component, and the second side of the seat element further comprises a second peripheral rib for directly engaging the second component and providing a seal between the seat element and the second component, the second side of the seat element further comprising a second peripheral channel disposed radially inwardly from the second peripheral rib, the second peripheral channel for accommodating at least a portion of the second peripheral rib as the second side of the seat element is pressed against the second component.

2. The ball valve seat of claim 1 wherein the carrier plate is fabricated from an injection molded material.

3. The ball valve seat of claim 1 wherein the annular seat element is fabricated from an elastomer material.

4. An improved air operated diaphragm pump comprising a outer chamber which is connected to a manifold assembly, the pump further comprising a ball valve disposed between the outer chamber and the manifold, the ball valve comprising a ball and a ball valve seat mounted between a ball retainer component and a support component at the ball valve seat, the improvement comprising:

a one-piece non-resilient flat annular carrier plate comprising an outer periphery for attachment between the ball retainer component and the support component by sandwiching the outer periphery of the carrier plate between the ball retainer and support components of the carrier plate further comprising an inner wall for accommodating a one-piece resilient annular seat element for engaging the ball of the ball valve, the carrier plate further comprising a first side and a second side, the inner wall comprising a cut-out portion disposed at a junction of the inner wall and the first side of the carrier plate, the cut-out portion having wider diameter than a second portion of the inner wall deposed at a junction of inner wall and the second side of the carrier plate, the first side of the carrier plate engaging the ball retainer component, the second side of the carrier plate engaging the support component, the annular seat element comprising a central opening providing a flow path and an outer wall for engaging the inner wall of the carrier plate, the outer wall of the seat element comprising an upper flange that is accommodated in the cut-out portion of the carrier plate, the annular seat element further comprising a first side and a second side, the first side of the seat element having an outer periphery that sealingly engages the ball retainer component and provides a seal between the flow path and the first side of the carrier plate, the second side of the seat element having an outer periphery that sealingly engages the support component and provides a seal between the flow path and the second side of the carrier plate, the seat element being sandwiched between the ball retainer and support components and the outer peripheries of the first and second sides of the seat element and providing a seal between the flow path and the carrier plate, the first side of the seat element further comprises a first peripheral rib for directly engaging the ball retainer component and providing a seal between the seat element and the ball retainer component, the first side of the seat element further comprising a first peripheral channel disposed radially inwardly from the first peripheral rib, the first peripheral channel for accommodating at least a portion of the first peripheral rib as the first side of the seat element is pressed against the ball retainer component, and the second side of the seat element further comprises a second peripheral rib for directly engaging the support component and providing a seal between the seat element and the support component, the second side of the seat element further comprising a second peripheral channel disposed radially inwardly from the second peripheral rib, the second peripheral channel for accommodating at least a portion of the second peripheral rib as the second side of the seat element is pressed against the support component.

5. The pump of claim 4 wherein the carrier plate is fabricated from an injection molded material.

6. The pump of claim 4 wherein the annular seat element is fabricated from an elastomer material.

7. The pump of claim 6 wherein the ball retainer component comprises a cooperating groove for accommodating the first peripheral rib, and the support component comprises a cooperating groove for accommodating the second peripheral rib.

* * * * *